US005299444A

United States Patent [19]

Kirii et al.

[11] Patent Number: 5,299,444

[45] Date of Patent: Apr. 5, 1994

[54] HYDRAULIC CUSHIONING SYSTEM FOR PRESS, HAVING HYDRAULIC POWER SUPPLY INCLUDING MEANS FOR ADJUSTING INITIAL PRESSURE TO BE APPLIED TO PRESSURE-PIN CYLINDERS

[75] Inventors: Kazunari Kirii, Aichi; Tsutomu Ono; Masahiro Shinabe, both of Toyota, all of Japan

[73] Assignee: Toyota Jidosha Kabushiki Kaisha, Toyota, Japan

[21] Appl. No.: 940,354

[22] Filed: Sep. 3, 1992

[30] Foreign Application Priority Data

Sep. 4, 1991 [JP] Japan ..... 3-254822
Sep. 6, 1991 [JP] Japan ..... 3-255744

[51] Int. Cl.[5] ..... B21J 7/28

[52] U.S. Cl. ..... 72/453.13; 72/351; 72/20; 100/259; 267/119

[58] Field of Search ..... 72/20, 351, 453.13; 100/259; 267/119

[56] References Cited

U.S. PATENT DOCUMENTS 4,592,220 6/1986 Martinez et al. ..... 72/16
4,635,466 1/1987 Seki et al. ..... 72/453.13
4,669,298 6/1987 Kono et al. ..... 72/453.13

FOREIGN PATENT DOCUMENTS 0312809 4/1989 European Pat. Off. .
0227058 9/1985 Fed. Rep. of Germany ... 72/453.13
0097819 7/1980 Japan ..... 72/453.13
63-34753 9/1988 Japan .
1-60721 4/1989 Japan .
0249227 10/1989 Japan ..... 72/453.13
2-39622 10/1990 Japan .
3-24245 5/1991 Japan .
509322 7/1939 United Kingdom .

OTHER PUBLICATIONS

Patent Abstracts of Japan, vol. 9, No. 155 (M-392) (1878) Jun. 29, 1985, of Japan Patent Publication 60-30530, Feb. 16, 1985.

European Search Report dated Dec. 3, 1992 (2 pages) and Communication dated Dec. 30, 1992 (1 page).

*Primary Examiner*—Lowell A. Larson
*Assistant Examiner*—Thomas C. Schoeffler
*Attorney, Agent, or Firm*—Finnegan, Henderson, Farabow, Garrett & Dunner

[57] ABSTRACT

A hydraulic cushioning apparatus for a press having an upper and a lower die assembly (3, 9) for forming a sheet-like workpiece (6), including hydraulic cylinders (54) incorporated in one of the upper and lower die assemblies, and pressure pins (52) linked with the respective hydraulic cylinders. The pressure pins are reciprocable to apply a cushioning force (F) to the workpiece, in a pressing action of said die assemblies on the workpiece, so as to force the workpiece against the other die assembly. The apparatus is equipped with a hydraulic power supply device (72, 100, 117, 272) for delivering a pressurized fluid to the hydraulic cylinders (54). The power supply device is capable of changing an initial hydraulic pressure ($P_0$) of the fluid to be applied to the hydraulic cylinders before the pressing action of said die assemblies.

10 Claims, 8 Drawing Sheets

1
2
3
4
4a
6
8
8a
9
10
12
14
16
18
20
22
24
26
28
30
50
52
54
56
58
59
60
62
64
66
68
70
72
AIR
REGULATOR
CONTROLLER

HYDRAULIC CUSHIONING SYSTEM FOR PRESS, HAVING HYDRAULIC POWER SUPPLY INCLUDING MEANS FOR ADJUSTING INITIAL PRESSURE TO BE APPLIED TO PRESSURE-PIN CYLINDERS

BACKGROUND OF THE INVENTION

1. Field of the Invention

The present invention relates in general to a hydraulic cushioning apparatus for a press, which has hydraulic cylinders linked with pressure pins, and more particularly, to such a cushioning apparatus which is capable of applying a cushioning force to a workpiece uniformly through the pressure pins, over a wide range of the cushioning force.

2. Discussion of the Prior Art

A drawing press, for example, is equipped with a hydraulic cushioning apparatus, which includes a pressure pad or ring that is operated by a plurality of pressure pins, to force a portion of the workpiece against a die or punch, for preventing wrinkling of the workpiece and assuring high surface quality of the formed or drawn piece. While the required cushioning force is transmitted to the pressure pad through the pressure pins, the force or load acting on one pressure pin may differ from that acting on the other pressure pins, due to a slight difference in the length of the pins, variations or errors in the relative positions of the other components (e.g., cushion platen) of the cushioning apparatus, and wearing of the components. For instance, the different lengths of the pressure pins cause different contacting pressures of the pins with respect to the pressure pad, and/or a spacing between the ends of some of the pins and the facing surface of the pressure pad, which spacing results in the failure of those pins to transmit any cushioning force. Thus, the cushioning force may be unevenly distributed to the pressure pins.

To avoid such uneven distribution of the cushioning force to the pressure pins, the pressure pins are linked, at their ends remote from the pressure pad, to the pistons of respective hydraulic cylinders, as disclosed in laid-open Publications Nos. 1-60721 and 2-39622 of unexamined Japanese Utility Model Applications. The hydraulic cylinders function to absorb the dimensional and/or positional variations or errors associated with the pressure pins indicated above, so that substantially the same cushioning force is transmitted through each of the pressure pins, so as to assure uniform cushioning pressure acting on the surface of the pressure pad over the entire working surface.

It is necessary to consider the conditions in which all the pressure pins are correctly operable to transmit substantially the same cushioning force to the pressure pad, for uniform cushioning pressure on the pressure pad. Generally, an average operating stroke Xav of the hydraulic cylinders (pressure pins) is represented by the following equation (1):

$$Xav=(F-nSP_0)V_0/(n^2S^2K) \quad (1)$$

where, $P_0$: initial hydraulic pressure to be applied to the hydraulic cylinders;

F: required cushioning force F to be applied to the pressure pad;

S: cross sectional area of the piston of each hydraulic cylinder;

n: number of the hydraulic cylinders (pins);

K: volume modulus of elasticity of the working fluid

According to the above equation (1), a relationship among the cushioning force F, number n of the pressure pins and average operating stroke Xav of the hydraulic cylinders is represented by a graph as shown in FIG. 9, in which the cushioning force F is taken along the horizontal axis while the number n of the pressure pins is taken along the vertical axis.

If the average operating stroke Xav of the hydraulic cylinders is too small, the relatively short pressure pins may not function to transmit the cushioning force, due to the spacing between the upper ends of those short pressure pins and the pressure pad. If the average operating stroke Xav is too large, on the other hand, some of the pressure pins may be bottomed with their lower ends reaching the lower stroke end, namely, the pistons of the corresponding hydraulic cylinders are bottomed, when the speed of downward movement of the upper movable die (press slide) is too high at the time when the movable die collides with the workpiece to force the workpiece against the pressure pad. Thus, the cushioning force cannot be evenly distributed to the pressure pins, or the pressure pad cannot be uniformly pressed against the workpiece by the pressure pins, if the average operating stroke of the hydraulic cylinders (pressure pins) is too large or too small.

For the above reason, the average operating stroke Xav should be held within an optimum range R between a certain lower limit and a certain upper limit, for example, between Xb(mm) and Xd(mm), as indicated by a hatched area in FIG. 9.

It will be understood from the above equation (1) that the optimum range R changes with the initial hydraulic pressure $P_0$ to be applied to the hydraulic cylinders, a total amount $V_0$ of the fluid in the hydraulic cylinders, the cross sectional area S of each hydraulic cylinder, and the volume modulus K of the fluid.

However, the known hydraulic cushioning apparatus is not capable of changing the initial hydraulic pressure $P_0$. Further, the fluid volume $V_0$ and cross sectional area S of the hydraulic cylinders, and the volume modulus K of elasticity of the fluid are fixed. Therefore, the optimum range R is fixed, and cannot be changed. Usually, the number n of the pressure pins is fixed, but the required cushioning force F is changed to meet the particular material and thickness of the workpiece, or changed in steps for the purpose of finding out the optimum pressing condition, in a test pressing operation. Accordingly, the initially selected cushioning force F which falls within the optimum range R may be changed to a value outside the optimum range R.

To perform pressing operations with the suitable cushioning force F within the optimum range R, the number n of the pressure pins or the structure of the die assembly of the press should be changed. This requires considerable labor and time, and is not practically possible.

Moreover, the uneven distribution of the cushioning force F to the pressure pins, or the bottoming of the cylinder pistons, cannot be detected until a pressing operation on the workpiece is finished. Namely, those defects of the cushioning apparatus can be detected only after the finding of the formed or drawn pieces having poor quality due to the defects of the cushioning apparatus.

SUMMARY OF THE INVENTION

It is therefore an object of the present invention to provide a hydraulic cushioning apparatus for a press, which is capable of applying a cushioning force uniformly to the workpiece, equally through all the pressure pins, over a wide range of the cushioning force, without changing the number of the pressure pins or the structure of the die assembly of the press.

The above object may be achieved according to the principle of the present invention, which provides a hydraulic cushioning apparatus for a press having an upper and a lower die assembly for forming a workpiece in the form of a strip, including a plurality of hydraulic cylinders incorporated in one of the upper and lower die assemblies, and a plurality of pressure pins which are linked with the hydraulic cylinders, respectively, and which are reciprocable to apply a cushioning force to the workpiece, in a pressing action of the die assemblies on the workpiece, so as to force the workpiece against the other of the upper and lower die assemblies, the apparatus being characterized by comprising a hydraulic power supply device for delivering a pressurized fluid to the hydraulic cylinders. The hydraulic power supply device includes pressure changing means for changing an initial hydraulic pressure of the fluid which is applied to the hydraulic cylinders before the pressing action of the die assemblies is started.

In the hydraulic cushioning apparatus for a press of the present invention constructed as described above, the pressure pins incorporated in one of the upper and lower die assemblies are linked with the respective hydraulic cylinders, and are reciprocable to apply a cushioning force to the workpiece in the form of a strip, during a pressing action of the upper and lower die assemblies, so as to force the workpiece against the other die assembly, and thereby prevent wrinkling of the workpiece in the process of pressing, for assuring smooth surfaces of the formed piece produced by the pressing action.

The hydraulic cylinders are activated by the pressurized fluid delivered from the hydraulic power supply device. This power supply device includes pressure changing means for changing the initial hydraulic pressure of the fluid to be applied to the hydraulic cylinders before the pressing action of the die assemblies on the workpiece. Accordingly, the range in which the cushioning force is uniformly applied to the workpiece through the pressure pins can be changed or shifted by changing the initial hydraulic pressure.

Hence, the present hydraulic cushioning apparatus is capable of applying uniform cushioning pressure to the workpiece with substantially the same force action on each of the pressure pins, over a wide range of the cushioning force, without changing the number of the pressure pins or the structure of the die assemblies. In other words, the cushioning force to be applied to the workpiece having specific shape and size can be suitably selected over a wide range, while assuring the uniform application of the cushioning pressure through the pressure pins, on a given type of press equipped with a particular type of die assemblies.

The present cushioning apparatus, which is capable of changing the initial hydraulic force applied to the hydraulic cylinders for even distribution of the cushioning force to the pressure pins, has the following secondary advantages: a high degree of freedom in the selection of the pressing condition such as the number of the pressure pins and the cushioning force, which are suitable to prevent wrinkling or cracking of the workpiece under pressing and improve the yield ratio of the press; and a high degree of flexibility of application to various types of presses having different sizes and capacities, so as to assure high consistency in the quality of the formed pieces produced by the different presses.

According to one preferred arrangement of this invention, the hydraulic power supply device which also includes pressure generating means for generating the pressurized fluid further includes; pressure sensing means for detecting an actual hydraulic pressure in the hydraulic cylinders; calculating means for calculating an optimum hydraulic pressure which is to exist in the hydraulic cylinder, when the workpiece is forced by the pressure pins with substantially the same force acting on all of the pressure pins; and comparing means for comparing the actual hydraulic pressure detected by the pressure sensing means, with the optimum hydraulic pressure calculated by the calculating means.

The result of the comparison by the comparing means can be utilized to monitor the adequacy of the actual hydraulic pressure in the hydraulic cylinders for uniform application of the cushioning force to the workpiece. That is, if the detected actual pressure is equal to the calculated theoretical or optimum pressure, this means that all the pressure pins are correctly operated to apply the cushioning force uniformly to the workpiece, with substantially the same force acting on each pressure pin.

If some of the pressure pins do not work to apply any portion of the cushioning force to the workpiece, the force which acts on the other normally working pressure pins will increase, and the hydraulic pressure in the corresponding hydraulic cylinders will be accordingly raised. As a result, the detected actual hydraulic pressure exceeds the calculated optimum level. On the other hand, if some of the pressure pins are bottomed with the pistons of the corresponding hydraulic cylinders being bottomed to their lower stroke end, the force acting on the other normal pressure pins will decrease, and the hydraulic pressure in the corresponding cylinders will be accordingly lowered. In this case, the detected actual pressure is lower than the calculated optimum level.

Thus, the above preferred arrangement makes it possible to change the initial hydraulic pressure according to the result of the comparison of the detected actual pressure with the calculated optimum pressure, so that all the pressure pins normally function to assure uniform cushioning pressure being applied to the workpiece, with substantially the same force acting on each of the pressure pins.

When suitable display means is provided for indicating the result of the comparison by the comparing means, the operator of the pressure may manipulate the hydraulic power supply device to change the initial hydraulic pressure, according to the indicated result of the comparison, so that the detected actual pressure coincides with the calculated optimum pressure.

It will be understood that the pressure sensing means, calculating means and comparing means according to the above preferred arrangement may be utilized as the pressure changing means. For automatic adjustment of the initial hydraulic pressure, the pressure changing means further comprises commanding means for commanding the pressure generating means to change the initial hydraulic pressure, according to the result of comparison of the actual hydraulic pressure with the optimum hydraulic pressure by the comparing means.

According to the above arrangement, the initial hydraulic pressure is automatically changed by the commanding means, which activates the pressure generating means when the detected actual pressure is not equal to the calculated optimum pressure.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
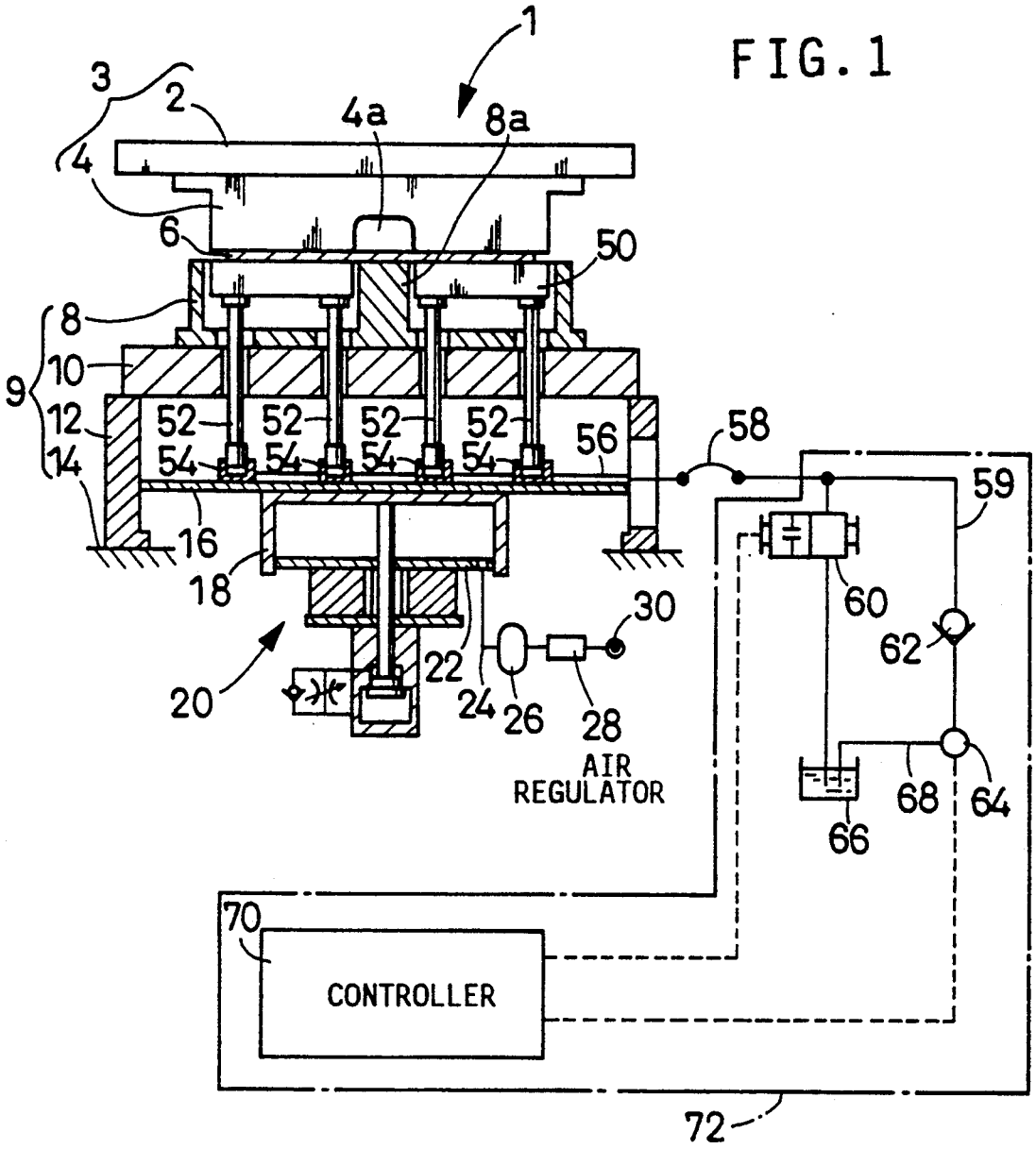
FIG. 1 is a fragmentary view partly in cross section showing a press equipped with one embodiment of a hydraulic cushioning apparatus of the present invention.

Referring first to FIG. 1, reference numeral 1 denotes a press for forming a workpiece in the form of a metal strip 6. The press 1 has a press slide 2, and an upper movable die 4 carried by the press slide 2. The press slide 2 and the movable die 4 constitute an upper die assembly 3. The upper die assembly 3 is moved up and down in the vertical direction, relative to a lower die assembly 9.

The lower die assembly 9 includes a lower stationary die 8 fixed to a bolster 10, a press bed 12 supporting the bolster 10, and a press base 14 on which the bed 12 is fixedly supported.

The upper movable die 4 and the lower stationary die 8 have respective cylindrical recess 4*a* and projection 8*a* which are aligned with each other. When the movable die 4 is moved down toward the stationary die 8, the cylindrical recess and projection 4*a*, 8*a* cooperate to perform a pressing action on the workpiece 6 placed between the dies 4, 8, to draw the workpiece 6 into a cylindrical product.

Within the lower stationary die 8, there is provided a cushion pad in the form of a pressure ring 50 disposed radially outwardly of the cylindrical projection 8*a*. The pressure ring 50 is supported by the upper ends of a plurality of pressure pins 52. The lower ends of the pressure pins 52 are fixed to pistons of cushioning hydraulic cylinders 54, which are linked with a cushion platen 16 of a die cushioning device 20. When the upper movable die 4 is moved down relative to the lower stationary die 8, the pressure pins 52 are forced down a given distance, which is a predetermined operating stroke of the cylinders 54.

The die cushioning device 20 having the cushion platen 16 to which the cylindrical wall portions of the cylinders 54 are fixed includes: a cushioning air cylinder 18 which supports the cushion platen 16; a cushion plate 22 which slidably engages the air cylinder 18 and which is movable relative to the cushion platen 16; an air conduit 24 communicating with an air chamber defined by the air cylinder 18 and cushion plate 22; an air tank 26 communicating with the conduit 24; an air regulator 28 communicating with the air tank 26; and a pneumatic pressure source 30 communicating with the regulator 28. The pressure of the compressed air delivered from the pressure source 30 is regulated by the regulator 28, and the regulated pressure is applied to the air chamber through the tank 26 and the conduit 24.

When a pressing operation is performed on the press 1, the workpiece in the form of the metal strip 6 is first placed on the pressure ring 50, whose top surface is substantially flush with the top surface of the cylindrical projection 8*a* of the lower die 8. Then, the press slide 2 is lowered with the upper movable die 4, and the workpiece 6 is pressed by and between the upper and lower dies 4, 8. At this time, a force generated by the downward movement of the upper movable die 4 with the slide 2 is transmitted to the die cushioning device 20 through the pressure pins 52 and the cushioning hydraulic cylinders 54, whereby the die cushioning device 20 gives a suitable cushioning force, which acts on the workpiece 6 and the upper movable die 4. The pressing operation occurs such that a portion of the workpiece 6 radially outward of the cylindrical recess and projection 4*a*, 8*a* of the dies 4, 8 is pressed between the lower surface of the upper die 4, and the pressure ring 50 on which the cushioning force transmitted through the pins 52 acts. Thus, that portion of the workpiece 6 is protected against wrinkling, assuring smooth surface of the formed cylindrical piece.

As indicated above, the cushioning hydraulic cylinders 54 permit the plurality of pressure pins 52 to be moved down by a suitable distance, so as to give a suitable cushioning force to press the radially outer portion of the workpiece 6 against the upper die 4.

The hydraulic cylinders 54 communicate with each other through a manifold 56, which is connected to a fluid passage 59 through a flexible tube 58. The fluid passage 59 is connected to a hydraulic pump 64 through a check valve 62. The pump 64 is connected to a reservoir 66 through a conduit 68, and is operated to pressurize a working fluid from the reservoir 66, and deliver the pressurized fluid through the fluid passage 59. The fluid passage 59 is also connected to the reservoir 66 through a pressure regulating valve 60, which is a solenoid-operated shut-off valve. The hydraulic pump 64 and the shut-off valve 60 are electrically controlled by a controller 70. When the valve 60 is open, a pressurized working fluid delivered from the pump 64 through the check valve 62 and the fluid passage 59 is released into the reservoir 66. With the shut-off valve 60 turned on and off by the controller 70 at a controlled duty cycle, the pressure of the fluid applied to the hydraulic cylinders 54 can be suitably controlled.

It will be understood that the fluid passage 59, shut-off valve 60, check valve 62, pump 64, reservoir 66, conduit 68 and controller 70 cooperate to constitute a hydraulic power supply device 72 for delivering a controlled hydraulic pressure to the hydraulic cylinders 54. In other words, the hydraulic power supply device 72 has initial pressure changing means for changing the initial pressure in the hydraulic cylinders 54 at the start of a pressing cycle performed by the press 1.

Theoretically, the fluid pressures in all the hydraulic cylinders 54 in a pressing operation on the press 1 are substantially the same, so that the cushioning forces of the pressure pins 52 are substantially the same, so as to assure uniform cushioning pressure over the entire area of the pressure ring 50, for avoiding the wrinkling of the workpiece 6 to permit high quality of the formed piece.

There will be described the pressing operation with a uniform cushioning pressure applied to the pressure ring 50 by the pressure pins 52, according to the present embodiment.

Figure 9:
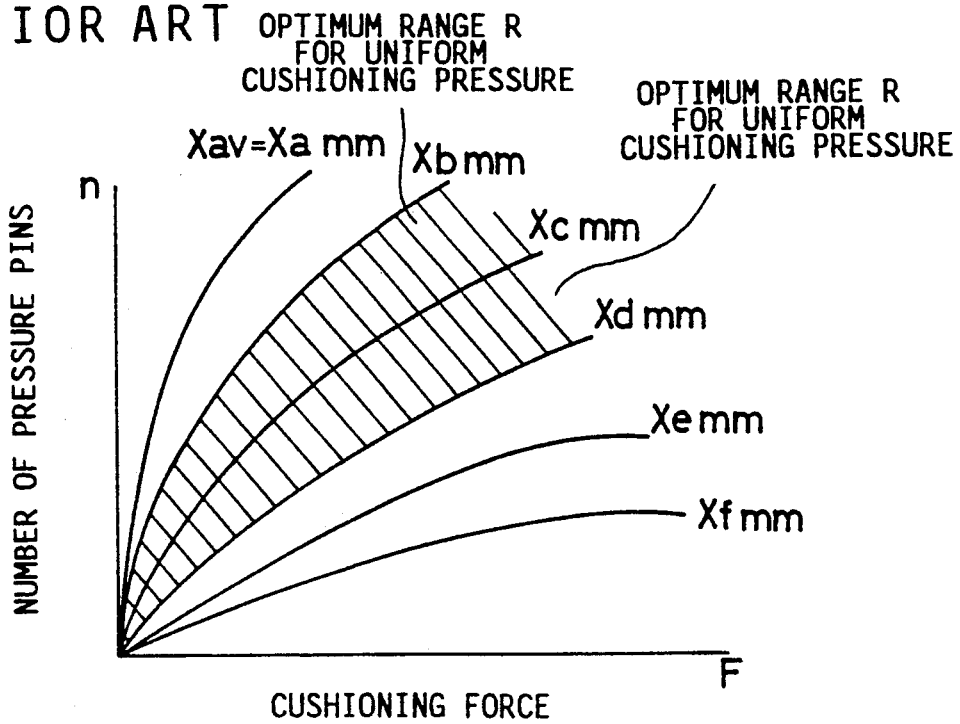
FIG. 9 PRIOR ART
FIG. 9 is a graph showing a relationship between the number of pressure pins and the cushioning force of the cushioning apparatus, in relation to the average stroke of the cushioning cylinder, in a known hydraulic cushioning apparatus.

As described above under the BACKGROUND OF THE INVENTION, the optimum range R in which a uniform cushioning pressure of the pressure ring 50 is obtained can be expressed by a graph as shown FIG. 9, with respect to the number n of the pressure pins 52, the required total cushioning force F and the average operating stroke Xav of the cylinders 54.

Figure 5:
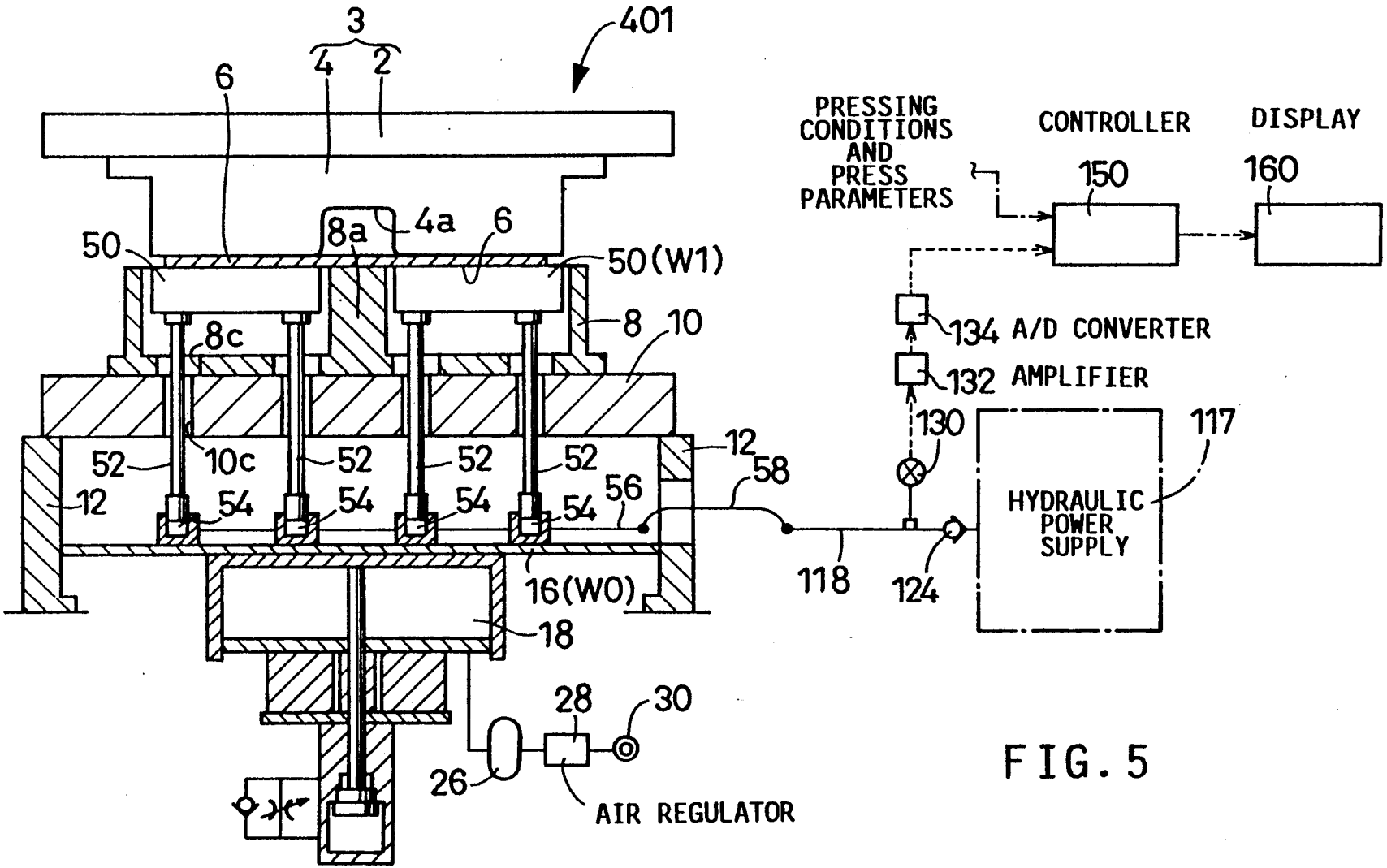
FIG. 5 is a fragmentary view partly in cross section of a fourth embodiment of the invention.

On the press equipped with the known hydraulic cushioning apparatus, the uniform cushioning pressure is obtained when the average operating stroke Xav of the cylinders 54 is within the optimum range between Xb(mm) and Xd(mm), as shown in FIG. 5. That is, the range R of the uniform cushioning pressure is determined and limited by the average operating stroke Xav of the cylinders 54.

In other words, the uniform cushioning pressure is not obtained when the average operating stroke Xav is smaller than Xb(mm) or larger than Xd(mm), for the following reasons:

Generally, the cushioning forces of the pressure pins differ from each other, due to variations in the length of the pressure pins and the vertical position of the hydraulic cylinders, and due to inclination of the cushion platen and the press slide. To eliminate the influence of these variations and inclination on the cushioning forces of the pressure pins, for obtaining substantially uniform cushioning pressure on the pressure ring or pad, the average operating stroke Xav of the hydraulic cylinders should be larger than a certain lower limit, for example, Xb(mm).

On the other hand, the press slide or movable die is considerably accelerated before the movable die comes into pressing contact with the workpiece. Therefore, the pressure ring or pad and the pressure pins are pressed down when the acceleration of the press slide is relatively high. This may cause bottoming of the pistons of the hydraulic cylinders which are fixed to the lower ends of the pressure pins. To avoid this bottoming, therefore, the average operating stroke Xav should be smaller than a certain upper limit, for example, Xd(mm), which is several millimeters smaller than the operating stroke Xs that causes the pistons to be bottomed.

For the above reason, the average operating stroke Xav of the hydraulic cylinders 54 should be held within the optimum range, for instance, between Xb(mm) and Xd(mm), as indicated in FIG. 9, in order to assure uniform cushioning pressure over the entire contact surface of the pressure ring or pad.

On ordinary presses, the average operating stroke Xav ranges from about 1 mm (Xa) to about 4 mm (Xf), and the uniform cushioning pressure is obtained when the average operating stroke Xav is held within the optimum range R of about 2 mm, which are defined by the lower and upper limits Xb and Xd.

As discussed above, the average operating stroke Xav of the hydraulic cylinders 54, which is represented by the above equation (1), varies with the required total cushioning force F and the number n of the pressure pins 52, and depends upon an initial hydraulic pressure $P_0$ applied to the hydraulic cylinders 54 from the hydraulic power supply device 72, an amount $V_0$ of the fluid in each cylinder 54, a cross sectional area S of each cylinder 54, and a volume modulus of elasticity K of the fluid.

On the known hydraulic cushioning apparatus, the initial hydraulic pressure $P_0$ cannot be changed, and therefore the optimum range R for uniform cushioning pressure is determined by the specification of the cushioning apparatus, as indicated in FIG. 9. Provided that the number n of the pressure pin 52 is unchanged, the uniform cushioning pressure cannot be obtained when the required cushioning force F is outside the optimum range R. In other words, the cushioning force F is limited to within a given range, to obtain the uniform cushioning pressure.

Figure 4:
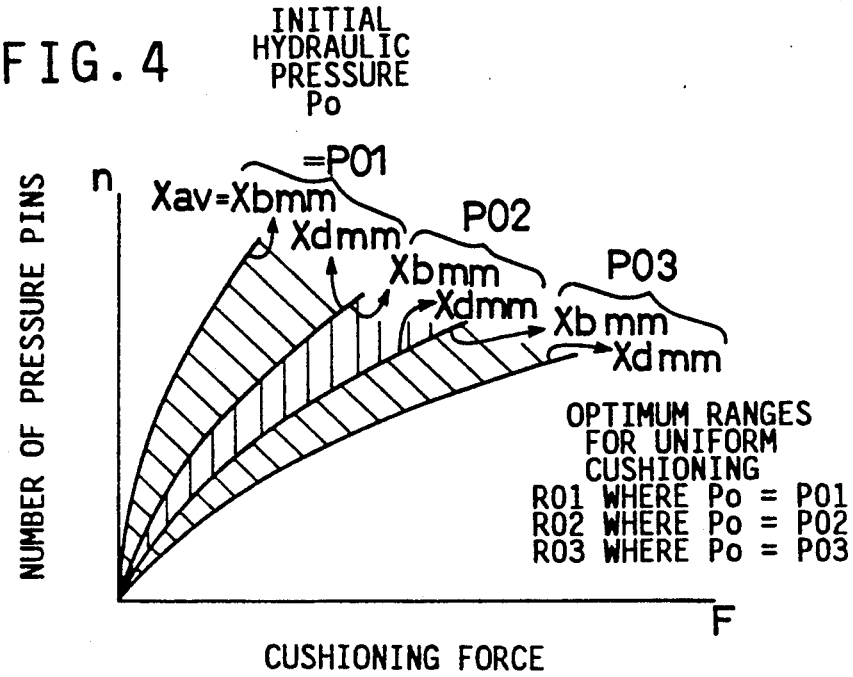
FIG. 4 is a graph showing a relationship between the number of pressure pins and the cushioning force of the cushioning apparatus, in relation to the average stroke and initial pressure of cushioning hydraulic cylinders for the pressure pins, according to the present invention.

On the press 1, the present hydraulic cushioning apparatus is equipped with the power supply device device 72 which is capable of adjusting the initial hydraulic pressure $P_0$ to be applied to the hydraulic cylinders 54, so as to obtain the uniform cushioning pressure, depending upon the number n of the pressure pins 52 and the required total cushioning force F. According to the present cushioning apparatus, the optimum range R can be changed with the initial hydraulic pressure $P_0$, as indicated in FIG. 4, so that the uniform cushioning pressure can be obtained over a wide range of combination of the number n of the pressure pins 52 and the required cushioning force F. Namely, the pressing operation can be performed with the desired total cushioning force F produced so as to assure uniform cushioning pressure over the entire area of the pressure ring 50, by suitably controlling the initial hydraulic pressure $P_0$.

Described more specifically, for a certain level of the initial hydraulic pressure $P_0$, the uniform cushioning pressure is obtained when the average operating stroke Xav of the hydraulic cylinders 54 is held within the optimum range between Xb(mm) and Xd(mm), as in the prior art described by reference to FIG. 9, since the mechanical structure of the cushioning apparatus on the present press 1 is similar to that of the known apparatus. Since the initial hydraulic pressure $P_0$ can be changed by the hydraulic power supply device 72, the optimum ranges R for two or more different levels P01, P02, P03, etc. of the initial hydraulic pressure $P_0$ can be juxtaposed to cover a large overall optimum range in which the uniform cushioning pressure can be obtained, as indicated in FIG. 4. If the different hydraulic pressure levels P01, P02, P03, etc. are selected so that the corresponding three optimum ranges R01, R02, R03, etc. are arranged such that the boundary Xb(mm) of one range is aligned with the boundary Xd(mm) of the adjacent range, the required range in which the initial hydraulic pressure $P_0$ should be changed can be minimized.

In the case of FIG. 4, the controller 270 of the power supply device 72 is adapted to provide three different levels P01, P02 and P03 of the initial hydraulic pressure $P_0$ to provide three juxtaposed optimum ranges R01, R02 and R03. The selection of one of these three initial hydraulic pressure levels makes it possible to perform a pressing operation with the cushioning force F selected over a considerably wide range, without having to change the number n of the pressure pins 52 or the specification of the press 1 or cushioning apparatus.

Figure 2:
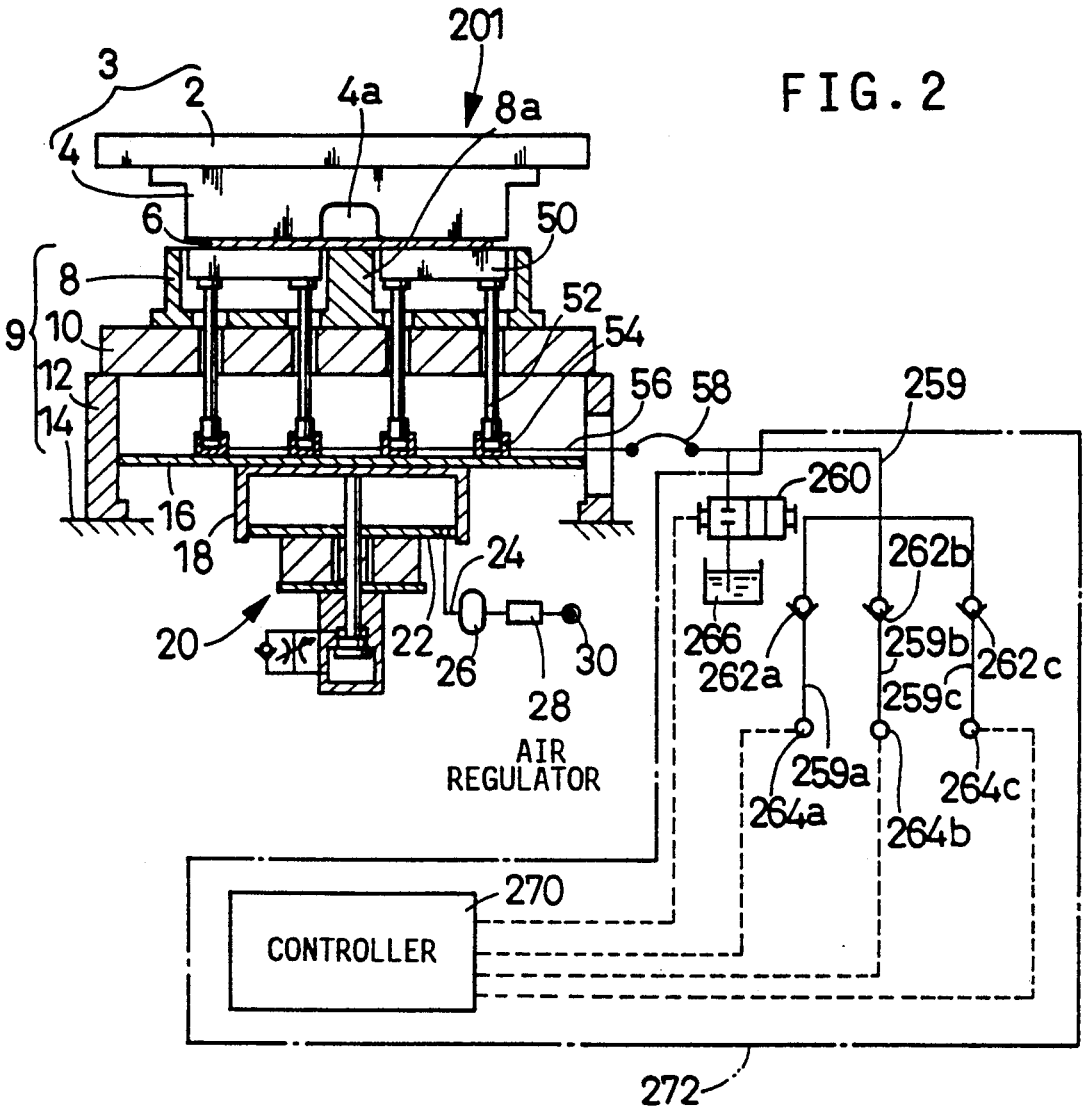
FIG. 2 is a fragmentary view partly in cross section showing another embodiment of the hydraulic cushioning apparatus of the invention.

Referring next to FIG. 2, there will be described a second embodiment of this invention. In FIG. 2, the same reference numerals as used in FIG. 1 are used to identify the corresponding components, which will not be described.

The hydraulic cushioning apparatus provided on a press 201 shown in FIG. 2 uses a hydraulic power supply device 272, which is connected to the hydraulic cylinders 54 through a fluid passage 259 which includes the flexible tube 58. The fluid passage 259 leads to three branch lines 259*a*, 259*b* and 259*c* which are connected to respective hydraulic pumps 264*a*, 264*b*, 264*c* through respective check valves 262*a*, 262*b*, 262*c*. The fluid passage 259 is also connected to a reservoir 266 through a pressure regulating valve 260. The three pumps 264*a*, 264*b*, 264*c* and the pressure regulating valve 260 are electrically controlled by a controller 270. The pumps 264*a*, 264*b*, 264*c*, pressure regulating valve 260 and controller 270 constitute a major part of the hydraulic power supply device 272.

In the present embodiment, the three pumps 264*a*, 264*b*, 264*c* have different ratings to produce different hydraulic pressures, so that the initial hydraulic pressure $P_0$ to be applied to the hydraulic cylinders 54 can be changed in three steps (P01, P02, P03), by operating one of the three pumps 264*a*, 264*b*, 264*c* under the control of the controller 270. The pressure regulating valve 260 is operated to make a fine adjustment of the hydraulic pressure of the fluid delivered from the selected one of the pumps 264, when such fine adjustment is required due to a variation in the operating condition of the press 201.

The present embodiment also assures uniform cushioning pressure to be applied to the pressure ring 50, by selecting one of the three different levels P01, P02 and P03 as the initial hydraulic pressure $P_0$, as shown in FIG. 4, as in the embodiment of FIG. 1. The selective operation of the three pumps 264*a*, 264*b*, 264*c* under the control of the controller 270 depending upon the desired cushioning force F and the number n of the pressure pins 52 permits a pressing operation, with the uniform cushioning pressure applied to the workpiece 6 and movable die 4 through the pressure pins 52. Since the pressure regulating valve 260 is not usually operated to control the initial hydraulic pressure $P_0$, the operation of the controller 270 can be simplified.

Figure 3:
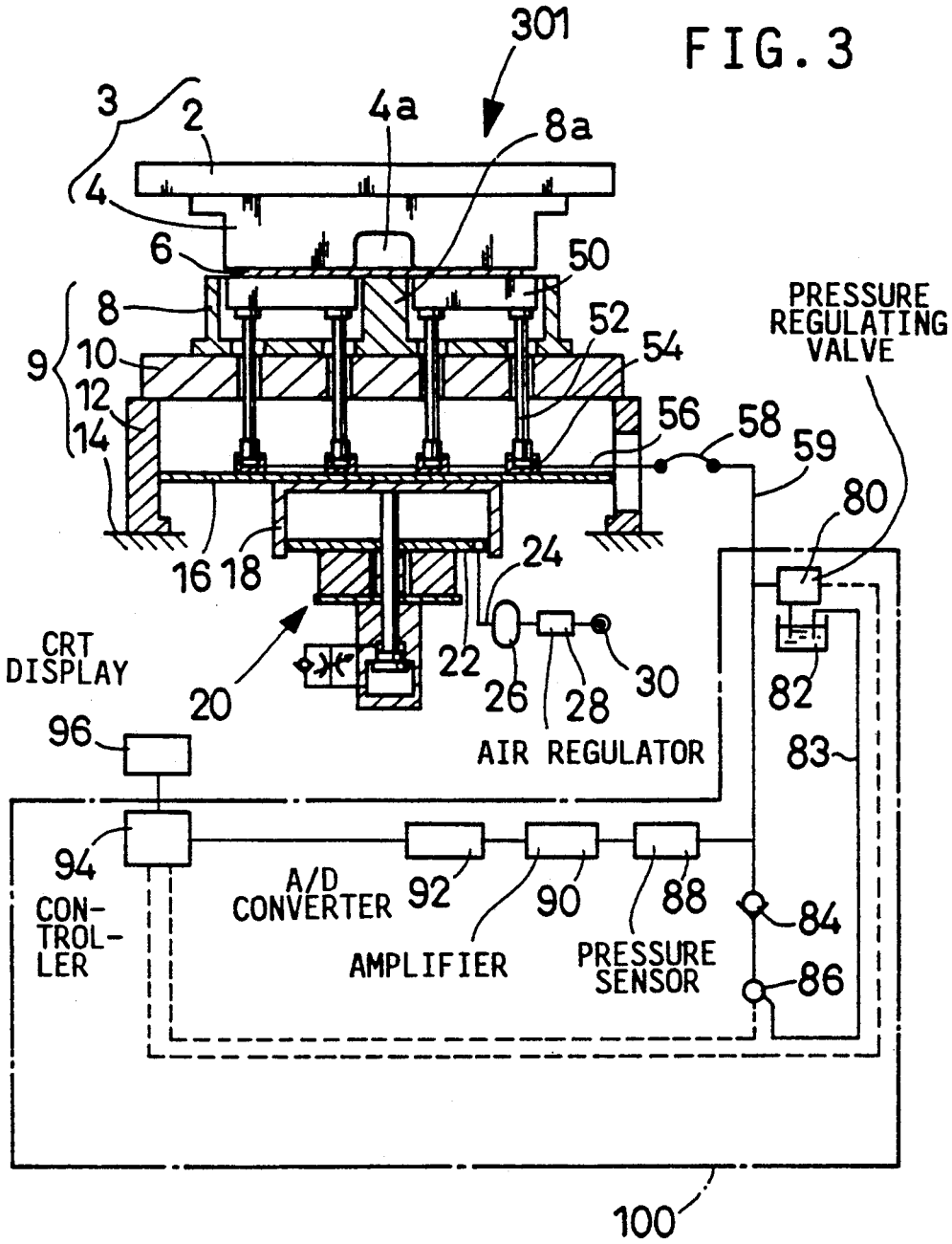
FIG. 3 is a fragmentary view partly in cross section showing a third embodiment of the invention.

A third embodiment of the invention as applied to a press 301 is illustrated in FIG. 3, wherein the hydraulic cushioning apparatus includes a hydraulic power supply device 100, which is constructed as described below. In this figure, too, the same reference numerals as used in FIG. 1 are used to identify the corresponding components.

The hydraulic power supply device 100 is connected to the hydraulic cylinders 54 through a fluid passage 79, which includes the flexible tube 58. The power supply device 100 incorporates a hydraulic pump 86 and a reservoir 82 which are connected to the fluid passage 79 through a check valve 84 and a pressure regulating valve 80, respectively. The reservoir 82 and the pump 86 are connected to each other by a conduit 83. The fluid passage 79, pressure regulating valve 80, reservoir 82 and pump 86 cooperate to constitute pressure generating means for producing a pressurized fluid to be supplied to the hydraulic cylinder 54.

The hydraulic power supply device 100 also incorporates a pressure sensor 88 connected to the fluid passage 79, an amplifier 90 connected to the pressure sensor 88, an analog/digital (A/D) converter 92 connected to the amplifier 90, and a controller 94 which receives the output of the A/I; converter 92. The pressure sensor 88 functions to detect the actual pressure in the hydraulic cylinders 54, through the fluid passage 79. The output of the pressure sensor 88 is amplified by the amplifier 90, and the output of the amplifier 90 is received by the A/D converter 92, which feeds the corresponding digital signal to the controller 94. The controller 94 operates to calculate the actual pressure in the hydraulic cylinders 54, on the basis of the output of the A/D converter 92, and activate a CRT display 96 to indicate the calculated actual pressure.

The controller 94 is a computer having a central processing unit (CPU), and a memory device. The controller 94 receives from a suitable external input device information on the pressing condition and the parameters of the press 301 such as the required or optimum cushioning force F, and calculates an optimum level P1 of the hydraulic pressure necessary to produce the required cushioning force F. The display 96 displays the received information and the calculated optimum hydraulic pressure P1.

The "optimum level P1" of the initial hydraulic pressure $P_0$ in the hydraulic cylinders 54 is the pressure level which permits the hydraulic cylinders 54 to cooperate with the other components of the cushioning mechanism to provide the required or optimum cushioning force F for uniform cushioning pressure, without the bottoming of the pistons of the cylinders 54. The method of calculating this optimum pressure level P1 will be described below.

The controller 94 also operates to compare the actual pressure Ps detected through the pressure sensor 88, with the calculated optimum pressure level P1, and control the pump 86 and the pressure regulating valve 80, so as to adjust the initial pressure $P_0$ to a suitable level.

It will be understood that the pressure sensor 88, amplifier 90 and A/D converter 92 cooperate to constitute pressure sensing means for detecting the actual pressure in the hydraulic cylinders 54, while the controller 94 serves as means for calculating the optimum hydraulic pressure P1. Further, the controller 94 serves as means for comparing the actually detected pressure Ps of the cylinders 54 with the optimum level P1, and also serves as means for commanding the pressure generating means 79-86 to operate to apply the optimum initial hydraulic pressure to the hydraulic cylinders 54.

The pressure pins 52 have more or less different lengths. If the initial hydraulic pressure $P_0$ applied to the hydraulic cylinders 54 at the start of a pressing cycle is higher than required, only the relatively long pressure pins 52 press down the cushion platen 16 of the die cushioning device 20, with the upper ends of the relatively short pressure pins 52 spaced apart from the lower surface of the pressure ring 50.

Suppose the number of the pressure pins 52 whose upper ends are spaced apart from the pressure ring 50 and which do not cause the corresponding pistons of the cylinders 54 to be moved down is equal to "m", the actual pressure Ps of the cylinders 54 detected by the sensor 88 is represented by the following equation (2):

$$Ps=F/(n-m)S \quad (2)$$

where,

S: cross sectional area of each cylinder 54

On the other hand, the calculated optimum pressure P1 is represented by the following equation (3):

$$P1=F/nS \quad (3)$$

It will be understood that the detected pressure Ps is higher than the calculated optimum pressure P1. In this case, the controller 94 commands the pressure generating means 79–86 to lower the initial hydraulic pressure $P_0$ so that the detected pressure Ps coincides with the optimum pressure P1.

If the initial hydraulic pressure $P_0$ generated by the hydraulic power supply device 100 is lower than required, the pistons of the cylinders 54 corresponding to some or all of the pressure pins 52 are bottomed when the cushion platen 16 of the die cushioning device 20 is pressed down by the pressure pins 52.

Suppose the number of the pressure pins 52 corresponding to the bottomed pistons is equal to "m", the cushioning force F is represented by the following equation (4):

$$F=(n-m)SP1+mSPb \quad (4)$$

where,

Pb: pressure higher than P1, due to the bottoming of the cylinder pistons

In this case, the detected pressure Ps is represented by the following equation (5):

$$\begin{aligned} Ps &= (F-mSPb)/\{(n-m)S\} \\ &= (nSP1-mSPb)/\{(n-m)S\} \end{aligned} \quad (5)$$

Since SPb is higher than Sp1, the following inequality (6) is obtained from the equation (5):

$$Ps=(nSP1-mSPb)/\{(n-m)s\}<P1=(nSP1-mSP1-)/\{(n-m)S\} \quad (6)$$

The inequality Ps<P1 means that the initial hydraulic pressure $P_0$ should be raised to the calculated optimum level P1, and the pressure generating means 79–86 is commanded by the controller 94 to accordingly raise the initial hydraulic pressure $P_0$ to be applied to the hydraulic cylinders 54.

As described above, when the detected pressure Ps is higher than the optimum level P1, this indicates that there is at least one pressure pin 52 whose upper end is spaced apart from the pressure ring 50 when the cushion platen 16 is pressed down. On the other hand, when the detected pressure Ps is lower than the optimum level P1, this indicates that there is at least one hydraulic cylinder 54 whose piston is bottomed when the cushion platen 16 is pressed down. When the detected and optimum pressure levels Ps and P1 are equal to each other, this means that all the pressure pins 52 equally contribute to transmit the cushioning forces to the pressure ring 50, so that the pressure ring 60 is forced against the workpiece 6 (or movable die 4) with uniform cushioning pressure over the entire surface of the ring 60.

If, for instance, a test pressing cycle is performed with the cushioning force F and the initial hydraulic pressure $P_0$=P04, and with the number of the effectively operating pressure pins 52 being equal to (n−m), the pressure Ps detected by the sensor 88 as expressed by the above equation (2) is higher than the optimum level P1, where "n" represents the total number of the pins 52 while "m" represents the number of the pins 52 which do not contribute to the cushioning action on the pressure ring 50. In this case, the controller 98 commands the pressure generating means 79–86 to lower the initial hydraulic pressure $P_0$ from the level P04 down to a level P05. As a result, the detected pressure Ps obtained in another test pressing cycle is lowered due to the reduction in the number m of the ineffective pressure pins 52. If the detected pressure Ps is still higher than the optimum level P1, the initial hydraulic pressure $P_0$ is further lowered. The test pressing cycle is repeated until the initial hydraulic pressure $P_0$ becomes equal to P06 (<P05), namely, until the detected pressure Ps becomes equal to the optimum level P1 at which the number of the effectively working pressure pins 52 is equal to "n".

If, on the other hand, the initial pressure $P_0$=P07 is lower than the optimum level=P06, the pistons of some of the cylinders 54 are bottomed, and the corresponding pressure pins 52 directly mechanically connect the cushion platen 16 and the pressure ring 50, whereby the detected pressure Ps is lower than the optimum level P1. In this case, therefore, the controller 94 commands the pressure generating means to gradually raise the initial hydraulic pressure $P_0$, eventually to the optimum level P06 at which the detected pressure Ps is equal to P1.

After the optimum initial hydraulic pressure $P_0$(P1) is determined and established during the test pressing operation, this value $P_0$ is stored in the memory device of the controller 98, and a production run of the press 301 is started. In each pressing cycle during the production run, the pressure Ps in the hydraulic cylinders 54 is detected by the pressure sensor 88 when the upper movable die 4 is placed at the upper stroke end. The controller 98 determines whether the detected actual pressure Ps coincides with the stored optimum value $P_0$. If the detected pressure Ps is not equal to the optimum value $P_0$, the controller 94 commands the display 96 to provide an indication that a test pressing cycle should be conducted to re-adjust the initial hydraulic pressure $P_0$.

In a test pressing cycle to determine the optimum initial hydraulic pressure $P_0$, the pressure sensor 88 serves to detect the actual pressure Ps while the pressure pins 52 are placed in the operated state. In production run, on the other hand, the pressure sensor 88 serves to detect the pressure Ps (initial hydraulic pressure $P_0$) at the start of each pressing cycle before the pressure pins 52 are brought to the operated state, in order to check if the initial pressure $P_0$ is optimum or not.

As described above, the press 301 equipped with the hydraulic cushioning apparatus according to the third embodiment of the invention is capable of changing the initial hydraulic pressure applied to the hydraulic cylinders 54, based on the detected actual pressure Ps compared with the calculated optimum According to the press 301 of the present third embodiment constructed as described above, the detected actual hydraulic pressure Ps in the hydraulic cylinders 54 is compared with the calculated optimum hydraulic pressure P1, and the initial hydraulic pressure $P_0$ of the fluid delivered from the power supply device 100 is adjusted so that the detected actual pressure Ps coincides with the optimum level P1, so as to assure uniform cushioning pressure applied to the pressure ring 50 (workpiece 6 and movable die 4) through all of the pressure pins 52.

Although the cushioning mechanism 50, 52, 54, 20 is provided for the lower die assembly 9, the mechanism may be provided for the upper die assembly 3 so that the workpiece W is pressed by the cushioning force against the lower die assembly 9.

In the illustrated third embodiment, the detected actual pressure Ps is merely compared with the calculated optimum level P1 to determine whether the initial hydraulic pressure $P_0$ should be changed or not. However, it is possible to change the initial hydraulic pressure $P_0$ by an amount corresponding to a difference between the detected actual and calculated optimum pressure levels Ps, P1. This arrangement permits a fast adjustment of the initial hydraulic pressure $P_0$ to obtain the uniform cushioning pressure.

The third embodiment is also advantageous in that a change in the pressing condition is reflected on the detected actual hydraulic pressure Ps, during a pressing operation, and the initial hydraulic pressure $P_0$ is automatically compensated for this change from the nominal pressing condition, so that the pressing operation is always effected with the optimum initial hydraulic pressure $P_0$ depending upon the actual pressing condition.

The third embodiment is adapted such that the initial hydraulic pressure $P_0$ is automatically adjusted by the hydraulic power supply device 100, on the basis of the detected actual hydraulic pressure Ps and the optimum hydraulic pressure P1 which is calculated from the information received from an external input device. Namely, the controller 94 commands the pressure generating means 79-86 to change the initial hydraulic pressure $P_0$, depending upon a result of the comparison of the detected actual pressure Ps with the calculated optimum level P1. However, the third embodiment may be modified such that the controller 94 merely commands the display 96 to provide an indication of the result of the comparison. In this case, the operator of the press 301 can know whether the initial hydraulic pressure $P_0$ is higher or lower than required to assure uniform cushioning pressure, that is, whether the operator should manipulate the pressure generating means to raise or lower the initial hydraulic pressure $P_0$. This arrangement capable of monitoring the actual hydraulic pressure Ps against the optimum level P1 is effective to prevent troubles which may arise from excessively low or high pressure in the hydraulic cylinders 54, such as leakage of the working fluid from the hydraulic system.

Referring to FIGS. 5-8, an example of the modification of the third embodiment as indicated above will be explained. In this fourth embodiment, the same reference numerals as used in FIG. 3 are used to identify the corresponding components, which will not be described.

The hydraulic cushioning apparatus provided on a press 401 shown in FIG. 5 uses a hydraulic power supply 117, which is connected to the hydraulic cylinders 54 through a fluid passage 118 which includes the flexible tube 58 and a check valve 124. To the fluid passage 118, there is connected a pressure sensor 130 to detect the actual hydraulic pressure Ps in the hydraulic cylinders 54. The output of the pressure sensor 130 is fed to a controller 150 through an amplifier 132 and an analog/digital converter (A/D converter) 134. The control incorporates a central processing unit and a memory device. To the controller 150, there is connected a display 160.

Figure 6:
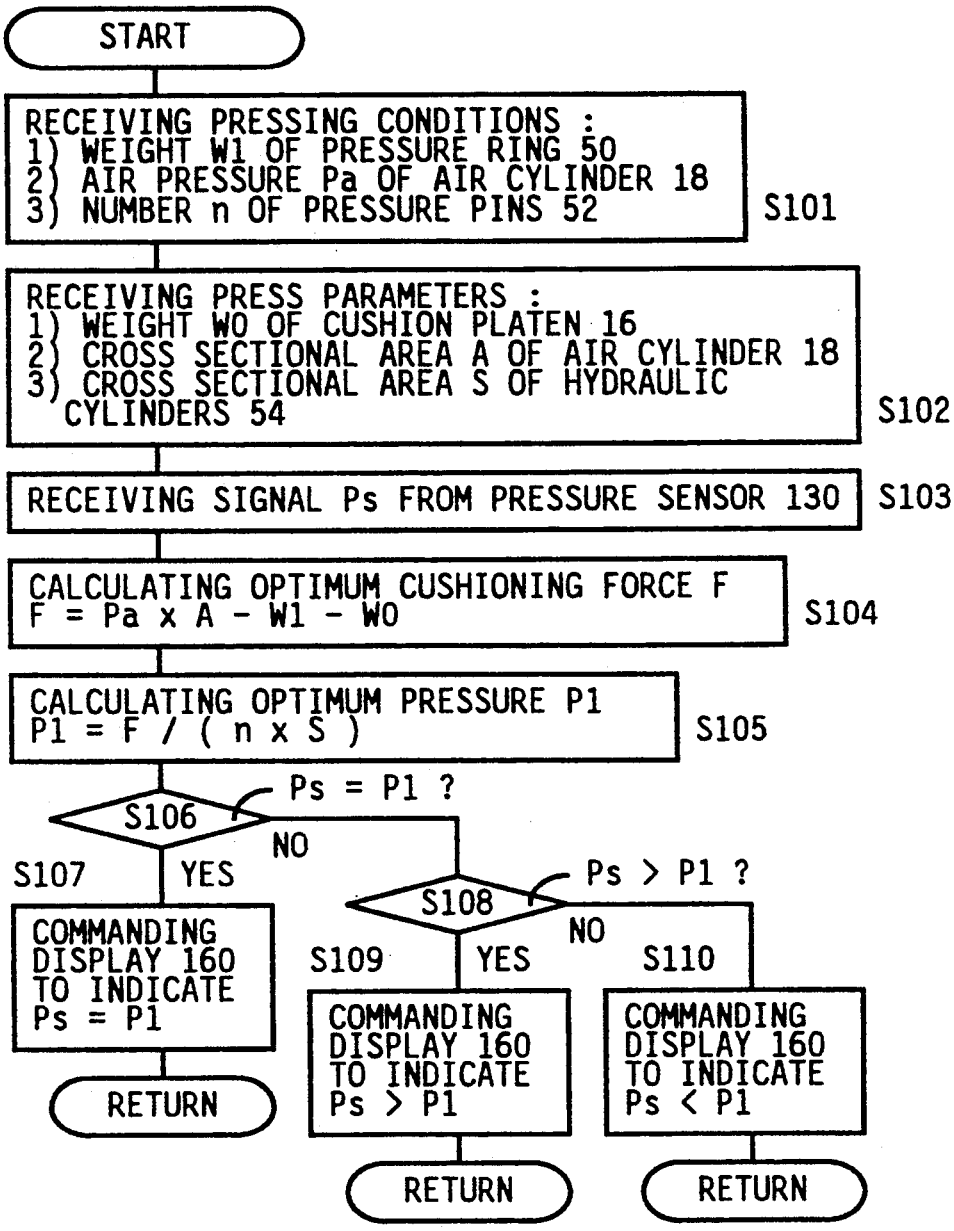
FIG. 6 is a flow chart illustrating a routine for monitoring an actual pressure in the cushioning hydraulic cylinders against a calculated optimum value.

Reference is now made to the flow chart of FIG. 6, which shows a routine executed by the controller 150, according to a control program stored in a read-only memory of the memory device, to monitor whether all the pressure pins 52 are effectively operable to assure uniform cushioning pressure on the pressure ring 50. The routine is repeated at a predetermined cycle time.

Initially, step S101 is implemented to receive from an external input device the pressing conditions, more specifically, cushioning conditions that are: weight W1 of the pressure ring 50; cushioning air pressure, i.e., air pressure Pa in the air cylinder 18; and number n of the pressure pins 52. Step S101 is followed by step S102 to receive from the external input device the parameters of the cushioning mechanism that are: weight W0 of the cushion platen 16; cross sectional area A of the air cylinder 18; and cross sectional area S of each hydraulic cylinder 54 (cross sectional area of the cylinder piston fixed to the lower end of each pressure pin 52). The control flow then goes to step S103 in which the controller 150 reads the output signal from the A/D converter 134, that is, the hydraulic pressure Ps in the hydraulic cylinders 54 detected by the pressure sensor 130.

Step S103 is followed by step S104 to calculate the cushioning force F by which the workpiece 6 is pressed by and between the pressure ring 6 and the upper movable die 4. The cushioning force F is calculated by the following equation (7):

$$F = Pa \times A = W1 - W0 \quad (7)$$

It will be understood from the above equation (7) that the cushioning force F is equal to a force ($Pa \times A$) of the air cylinder 18 acting on the pressure platen 16 in the upward direction, minus the total weight (W1+W0) of the pressure ring 50 and cushion platen 16.

It is noted that the weight W0 includes the weight of the pressure pins 52.

The control flow then goes to step S105 to calculate the optimum or theoretical hydraulic pressure P1, on the basis of the calculated cushioning force F, number n of the pressure pins 52 and cross sectional area S of the hydraulic cylinders 54. Suppose the same load or force acts on all of the pressure pins 52, a force Fl acting on each one of the pressure pins 52 is equal to (F/n), so that all the pressure pins 52 cooperate to transmit the cushioning force F to the pressure ring 50. To obtain the total cushioning force F, the pressure P1 in the hydraulic cylinders 54 should be equal to $F/(n \times S)$. In other words, the optimum pressure P1 necessary for all the pressure pins 52 to equally force the pressure ring 50 against the workpiece 6 is represented by the following equation (8):

$$P1=F/(n\times S) \quad (8)$$

Step S105 is followed by step S106 to determine whether or not the detected pressure Ps is equal to the calculated optimum pressure P1. If an affirmative decision (YES) is obtained in step S106, the control flow goes to step S107 in which the controller 150 commands the display 160 to indicate that the detected pressure Ps is equal to the optimum pressure P1, that is, the same force acts on all the pressure pins 52, and the cushioning force F acts on the pressure ring 50 uniformly over the entire working surface. The control flow then returns to step S101.

If the detected pressure is not equal to the optimum pressure P1, a negative decision (NO) is obtained in step S106, and the control flow goes to step S108 to determine whether the detected pressure Ps is higher than the optimum pressure P1. If the detected pressure Ps is higher than the optimum pressure P1, this indicates a possibility that some of the pressure pins 52 are not effectively working, or no cushioning force acts on some of the pins 52. If two pins 52 are not effectively working, the remaining number (n−2) of the pins 52 should receive the cushioning force F. In this case, the force F1 acting on each one of these effective pressure pins 52 is equal to F/(n−2), and the detected pressure Ps is equal to F/[S×(n−2)], which is higher than the optimum pressure Ps=F/(n×S). In this case, step S108 is followed by step S109 in which the controller 150 commands the display 160 to indicate that the detected pressure Ps is higher than the optimum pressure P1. The control flow then goes to step S101.

If the detected pressure Ps is lower than the optimum pressure, this indicates a possibility that some of the pressure pins 52 are bottomed or held at their lower stroke end, with the pistons of the corresponding cylinders 54 being bottomed. If two pressure pins 52 are bottomed, a cushioning; force f acting on each of these bottomed pins 52 is larger than that acting on the remaining normally working pins 52. In this case, the equilibrium represented by the following equation (9) is established:

$$F-2f=Ps\times S\times(n-2)] \quad (9)$$

Therefore, the detected pressure Ps is expressed by the following equation (10), which means that the detected pressure Ps is lower than the optimum pressure P1:

$$Ps=(F-2f)/[S\times(n-2) \quad (10)$$

In this case, the control flow goes to step S110 in which the controller 150 commands the display 160 to indicate that the detected pressure Ps is lower than the optimum pressure P1. The control flow then goes back to step S101.

Thus, the detected pressure Ps as compared with the optimum pressure P1 is indicated on the display 160, so that the operator of the press 401 can know whether all of the pressure pins 50 are effectively and correctly functioning so as to apply uniform cushioning pressure to the pressure ring 50.

Figure 7:
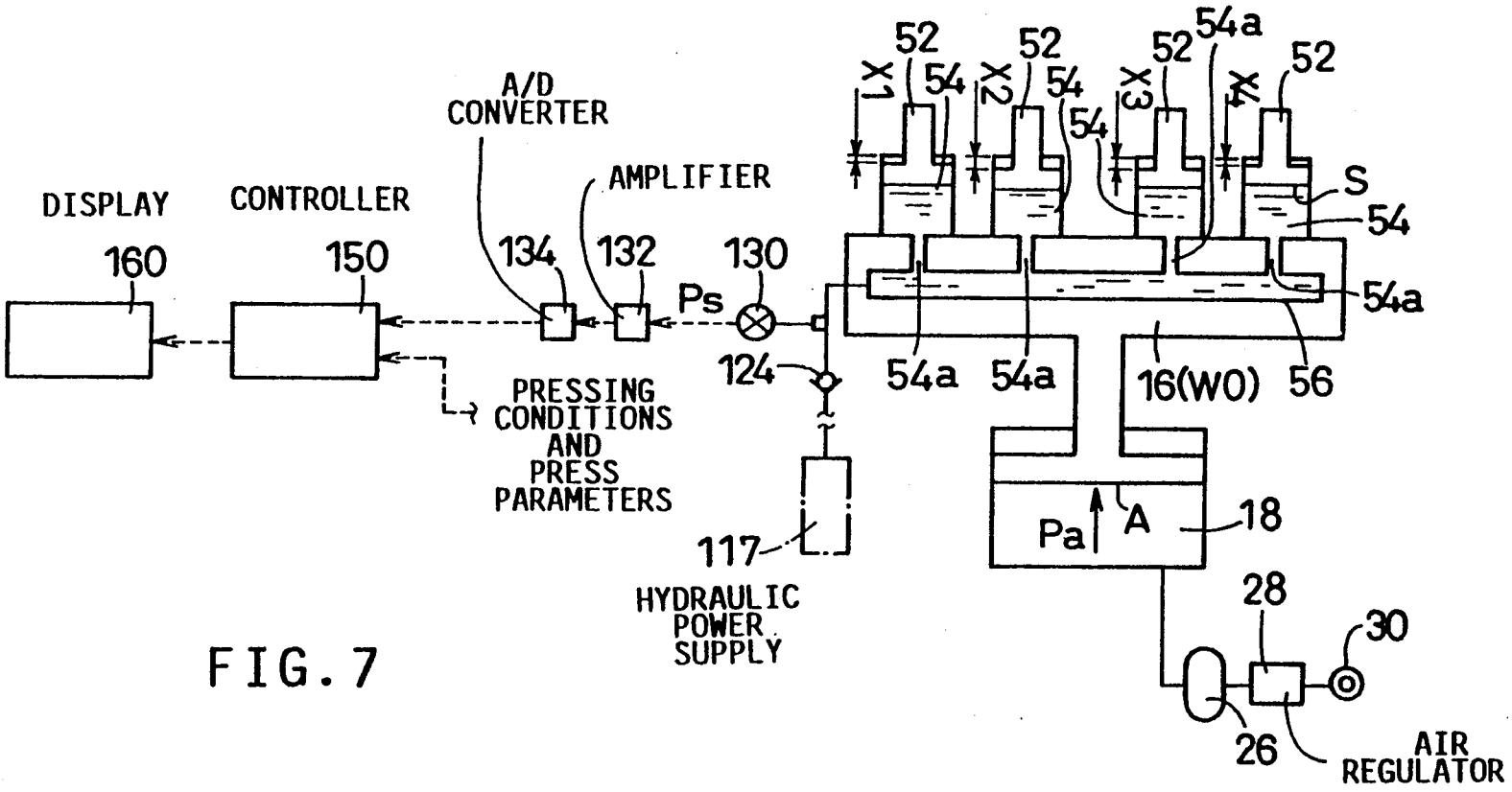
FIG. 7 is a view showing details of the cushioning hydraulic cylinders and an air cylinder.
Figure 8:
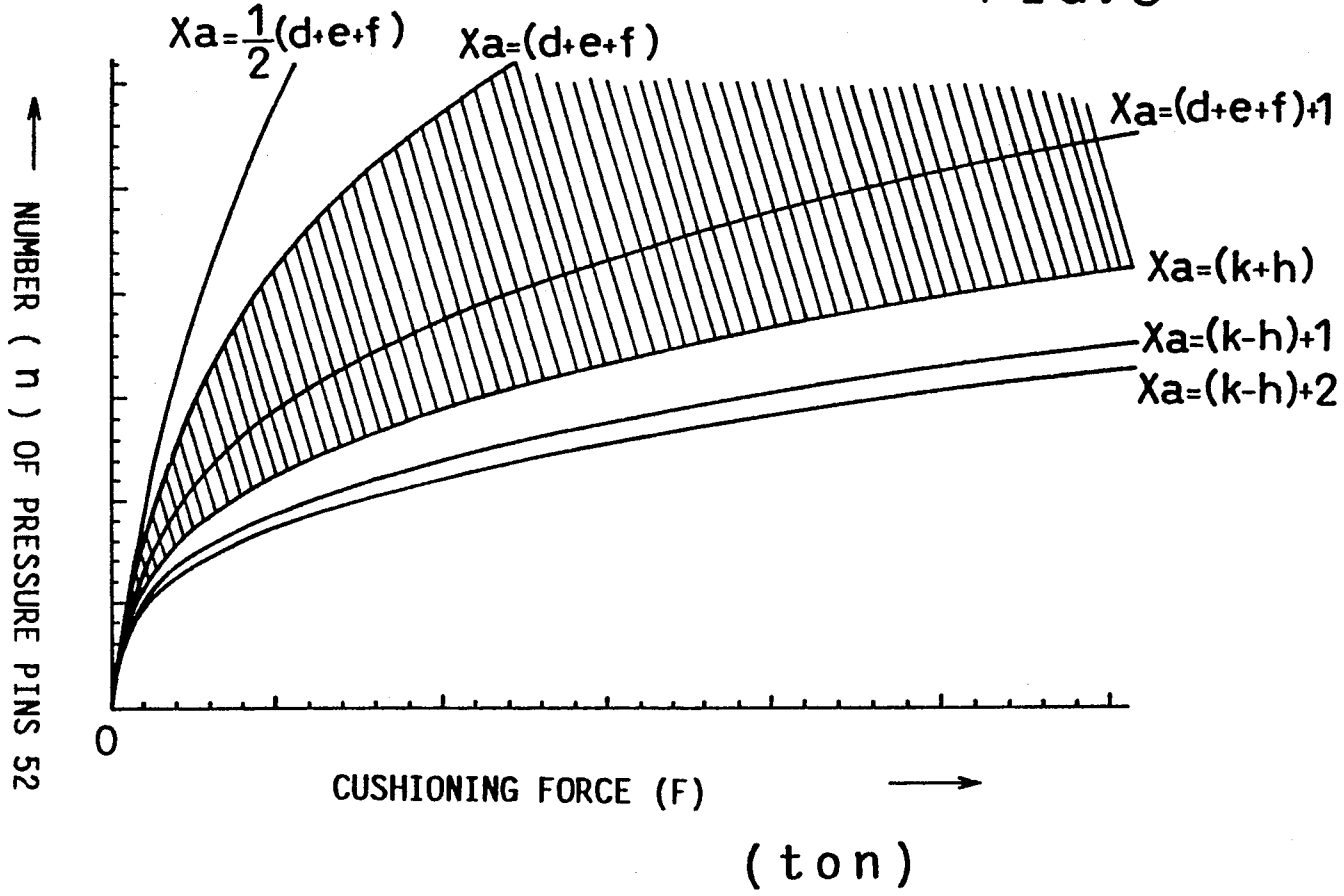
FIG. 8 is a graph showing a relationship between the number of pressure pins and the cushioning force of the apparatus, in relation to the average stroke of the cushioning hydraulic cylinders.

Referring to FIGS. 7 and 8, there will be discussed an operation of the pressure pins 52 to assure the uniform cushioning pressure on the pressure ring 50, in relation to the cushioning force F, number n of the pressure pins 52 and average operating stroke Xa of the hydraulic cylinders 54.

FIG. 7 indicates operating strokes X1, X2, . . . Xn of the hydraulic cylinders 54 when the cushioning force F is equally distributed to the pressure pins 52. The average operating stroke Xa of the cylinders 54 is equal to (X1+X2+X3+X4+ . . . +Xn)/n. By this average operating stroke Xa of the hydraulic cylinders 54, the pressure in the cylinders 54 rises from the initial value $P_0$ (before application of the cushioning force F to the pressure pins 52), to the optimum value P1. That is, there arises a difference ΔP which is represented by the following equation (11):

$$\Delta P=P_0-P1 \quad (11)$$

where, $$P1=F/(n\times S) \quad (8)$$

On the other hand, a total amount of displacement ΔV of the fluid caused by the average operating stroke Xa of the cylinders 54 is represented by the following equation (12):

$$\Delta V=S\times n\times Xa \quad (12)$$

Suppose $V_0$ represents the total volume of the fluid in the cylinders 54 before application of the cushioning force F to the pressure pins 52, a volume modulus of elasticity K of the fluid is represented by the following equation (13):

$$K=-\Delta P/(\Delta V/V_0) \quad (13)$$

From the above equations (11), (8), (12) and (13), the average operating stroke Xa of the cylinders 54 can be represented by the following equation (14):

$$Xa=(F-P_0\times S\times n)\times V_0/(S^2\times n^2\times K) \quad (14)$$

According to the above equation (14), the characteristic relationship among the cushioning force F, number n of the pressure pins 52 and average operating stroke Xa of the cylinders 54 can be expressed as shown in the graph of FIG. 8.

The pressure pins 52 inevitably have some variation of (d) mm in the length, while the hydraulic cylinders 54 have some variation of (e) mm in the vertical position due to an inevitable inclination of the cushion platen 16 with respect to the horizontal plane. Further, the upper movable die 4 has some variation of (f) mm in the local vertical position due to an inevitable inclination of the press slide 2 with respect to the horizontal plane. The amounts of these variations (d) mm, (e) mm and (f) mm are empirically known values. If these variations were absorbed by the movements of the pistons of the cylinders 54, the average operating stroke Xa of the cylinders 54 would amount to (d+e+f) mm.

When a drawing operation is performed with a single reciprocating movement of the movable die 4, the movable die 4 is usually considerably accelerated before the die 4 comes into pressing or colliding contact with the workpiece 6, and the pressure ring 50 is pressed down at a relatively high speed. In this case, the operating stroke of the cylinders 54 may be larger by a given distance of (h) mm, than the average operating stroke Xa during a normal pressing operation. That is, the pistons of the cylinders 54 (pressure pins 52) may be bottomed. To avoid this bottoming phenomenon, the average operating stroke Xa should be smaller than (k−h) mm, where k represents the maximum stroke of the cylinders 54.

For permitting all the pressure pins 52 to transmit the same cushioning load or force to the pressure ring 50 so as to assure uniform cushioning pressure acting thereon, the average operating stroke Xa of the cylinders 54 should be held within an optimum range between (d+e+f) mm and (k−h) mm. This optimum range is indicated by a hatched zone in the graph of FIG. 8. Thus, the uniform cushioning pressure acts on the pressure ring 50 if the number n of the pressure pins 52 and the cushioning force F are selected within the optimum range.

Even if the number n and the cushioning force F are selected within the optimum range indicated above, the cushioning force F may be not equally distributed to the pressure pins 52, due to changes in the cushioning condition, such as wearing of the pressure pins 52 and an error in the straightness or parallelism of the cushion platen 16 in the horizontal plane. However, this uneven distribution of the cushioning force F to the pressure pins 52 can be detected on the present press 401, on the basis of the detected actual pressure Ps as compared with the calculated optimum pressure P1, since the ineffective state or bottoming of some of the pressure pins 52 is detected as a difference of the detected pressure Ps from the optimum level Ps, which is indicated on the display 160. Therefore, the user of the press 401 can re-adjust the initial hydraulic pressure $P_0$ of the pressurized fluid delivered from the hydraulic power supply 117.

Although the fourth embodiment is not adapted such that the power supply 117 is controlled by the controller 150 so as to automatically adjust the initial hydraulic pressure $P_0$, the power supply 117 may be controlled by the controller 150, as in the third embodiment of FIG. 3, based on the difference between the detected and optimum pressures Ps and P1.

While the present invention has been described above in the presently preferred embodiment, it is to be understood that the invention is not limited to the details of the illustrated embodiments, but may be embodied with various changes, modifications and improvements, which may occur to those skilled in the art, in the light of the foregoing teachings.

For instance, the number of the pumps 264 used in the hydraulic power supply device 272 in the second embodiment may be suitably changed to change the initial hydraulic pressure $P_0$ in a desired number of steps. Further, the cushioning mechanism, and the related parts of the press may be suitably modified in the construction, configuration, dimensions, material and mechanical linkage, provided that the hydraulic power supply device is capable of changing the initial hydraulic pressure $P_0$, or the control system for the cushioning apparatus is capable of detecting and indicating the adequacy or inadequacy of the initial hydraulic pressure $P_0$ to permit the operator of the press to suitably adjust the initial hydraulic pressure $P_0$.

What is claimed is:

1. A hydraulic cushioning apparatus for a press having an upper and a lower die assembly for forming a workpiece in the form of a strip, including a plurality of hydraulic cylinders incorporated in one of said upper and lower die assemblies, and a plurality of pressure pins which are linked with said hydraulic cylinders, respectively, and which are reciprocable to apply a cushioning force to said workpiece, during a pressing action of said die assemblies on said workpiece, so as to force said workpiece against the other of said upper and lower die assemblies, said apparatus comprising:

a cushion pad supported by all of said pressure pins and on which said workpiece is placed;

a die cushioning device including a cushioning cylinder for producing said cushioning force during said pressing action, and a cushion platen receiving said cushioning force and being reciprocable during said pressing action;

said plurality of hydraulic cylinders fixedly disposed on said cushion platen such that said cushioning force produced by said cushioning cylinders is transmitted to said cushion pad through said hydraulic cylinders and said pressure pins;

connecting means through which said hydraulic cylinders communicate with each other; and a hydraulic power supply device for delivering a pressurized fluid to all of said hydraulic cylinders through said connecting means, said hydraulic power supply device including pressure changing means for changing an initial hydraulic pressure of said fluid applied to said hydraulic cylinders before said pressing action of said die assemblies, so that the hydraulic pressure in said hydraulic cylinders during said pressing action, performed with said workpiece being forced by said cushion pad, is controlled such that substantially the same force acts on all of said plurality of pressure pins.

2. A hydraulic cushioning apparatus according to claim 1, wherein said hydraulic power supply device further includes pressure generating means for generating said pressurized fluid, said pressure changing means comprising a controller for controlling said pressure generating means so as to change said initial hydraulic pressure.

3. A hydraulic cushioning apparatus according to claim 2, wherein said pressure generating means comprises a hydraulic pump for generating said pressurized fluid, and a pressure regulating valve which is controlled by said controller so as to change said initial hydraulic pressure.

4. A hydraulic cushioning apparatus according to claim 2, wherein said pressure generating means comprises a plurality of hydraulic pumps for generating said pressurized fluid, said hydraulic pumps having different ratings for respective different pressure levels of said pressurized fluid, said controller selectively activating one of said hydraulic pumps, so as to change said initial hydraulic pressure.

5. A hydraulic cushioning apparatus according to claim 1, wherein said hydraulic power supply device further includes:

pressure generating means for generating said pressurized fluid;

pressure sensing means for detecting an actual hydraulic pressure in said hydraulic cylinders;

calculating means for calculating an optimum hydraulic pressure which is to exist in said hydraulic cylinders, when said workpiece is forced by said cushion pad through said pressure pins with substantially the same force acting on all of said pressure pins; and comparing means for comparing said actual hydraulic pressure detected by said pressure sensing means, with said optimum hydraulic pressure calculated by said calculating means.

6. A hydraulic cushioning apparatus according to claim 5, further comprising display means for indicating a result of comparison of said actual and optimum hydraulic pressures by said comparing means.

7. A hydraulic cushioning apparatus according to claim 5, wherein said pressure changing means of said hydraulic power supply device comprises said pressure sensing means, said calculating means and said comparing means, and further comprises commanding means for commanding said pressure generating means to change said initial hydraulic pressure, according to a result of comparison of said actual and optimum hydraulic pressures by said comparing means.

8. A hydraulic cushioning apparatus according to claim 5, wherein said calculating means calculates said optimum hydraulic pressure on the basis of said cushioning force, number of said plurality of pressure pins, and a cross sectional area of each of said plurality of hydraulic cylinders.

9. A hydraulic cushioning apparatus for a press, comprising:

a pressure pad on which a workpiece is placed;

a plurality of pressure pins for supporting said pressure pad, a die cushioning device including a cushioning cylinder for producing a cushioning force during a pressing operation performed with said workpiece being forced by said cushion pad, and a cushion platen receiving said cushioning force and being reciprocable during said pressing action;

a plurality of hydraulic cylinders linked with said pressure pins, respectively, and fixedly disposed on said cushion platen such that said cushioning force produced by said cushioning cylinder is transmitted to said cushion pad through said hydraulic cylinders and said pressure pins;

connecting means through which said hydraulic cylinders communicate with each other;

a hydraulic power supply for delivering a pressurized fluid to all of said hydraulic cylinders through said connecting means;

pressure sensing means for detecting an actual hydraulic pressure in said hydraulic cylinders during said pressing operation;

calculating means for calculating an optimum hydraulic pressure which is to exist in said hydraulic cylinders during said pressing operation and which permits said workpiece to be forced by said pressure pad such that substantially the same force acts on all of said pressure pins; and comparing means for comparing said actual hydraulic pressure detected by said pressure sensing means, with said optimum hydraulic pressure calculated by said calculating means.

10. A hydraulic cushioning apparatus according to claim 9, further comprising display means for indicating a result of comparison of said actual and optimum hydraulic pressures by said comparing means.

* * * * *